US006550891B1

(12) United States Patent
Berg

(10) Patent No.: US 6,550,891 B1
(45) Date of Patent: Apr. 22, 2003

(54) ROTATING WIPER AND BLOTTER FOR INK JET PRINT HEAD

(75) Inventor: Richard H. Berg, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 53 days.

(21) Appl. No.: 09/722,629

(22) Filed: Nov. 28, 2000

(51) Int. Cl.[7] ..... B41J 2/165
(52) U.S. Cl. ..... 347/33
(58) Field of Search ..... 347/33, 22, 32, 347/24; 15/256.5; 101/155, 167, 425

(56) References Cited

U.S. PATENT DOCUMENTS 5,682,186 A * 10/1997 Bohorquez et al. ..... 347/29

FOREIGN PATENT DOCUMENTS

| | | | | |
|---|---|---|---|---|
| JP | 362077943 A | * | 4/1987 | ..... 347/33 |
| JP | 406023999 A | * | 2/1994 | ..... 347/33 |
| JP | 406071904 A | * | 3/1994 | ..... 347/33 |

* cited by examiner

*Primary Examiner*—John Barlow
*Assistant Examiner*—Shih-Wen Hsieh
(74) *Attorney, Agent, or Firm*—Oliff & Berridge, PLC

(57) ABSTRACT

A method and mechanism for wiping print heads is provided in the form of a plate with respect to which one or more wiping blades are mounted. The plate and blades are rotated past the print heads to wipe and clean the print heads. The mechanism fits in a relatively small amount of space.

21 Claims, 3 Drawing Sheets

FIG. 2
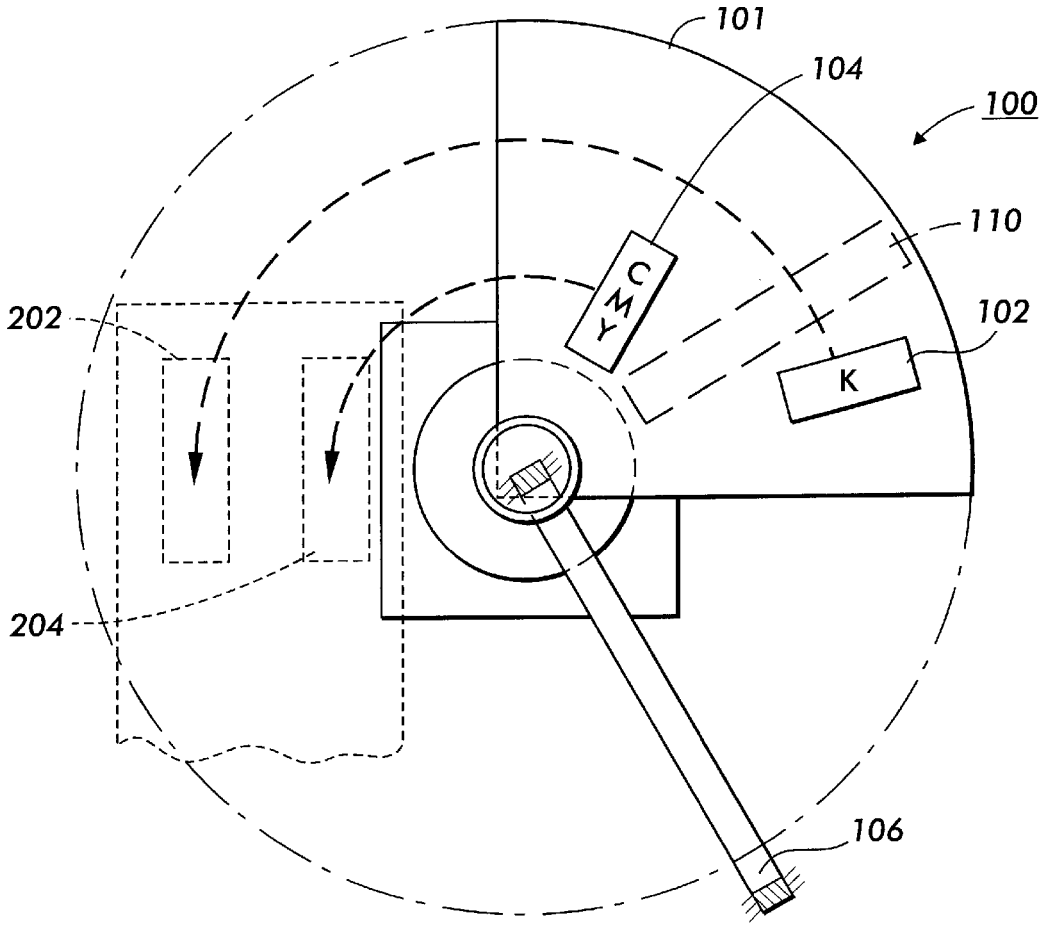
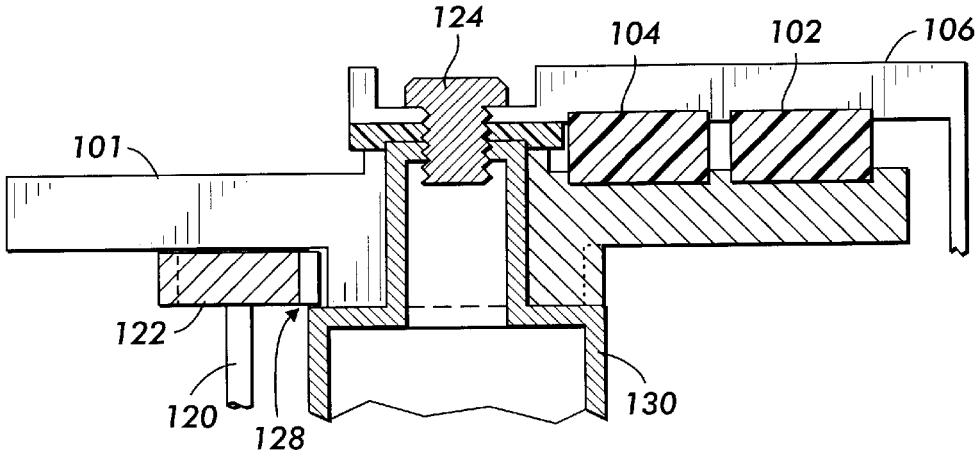
FIG. 3

FIG. 4
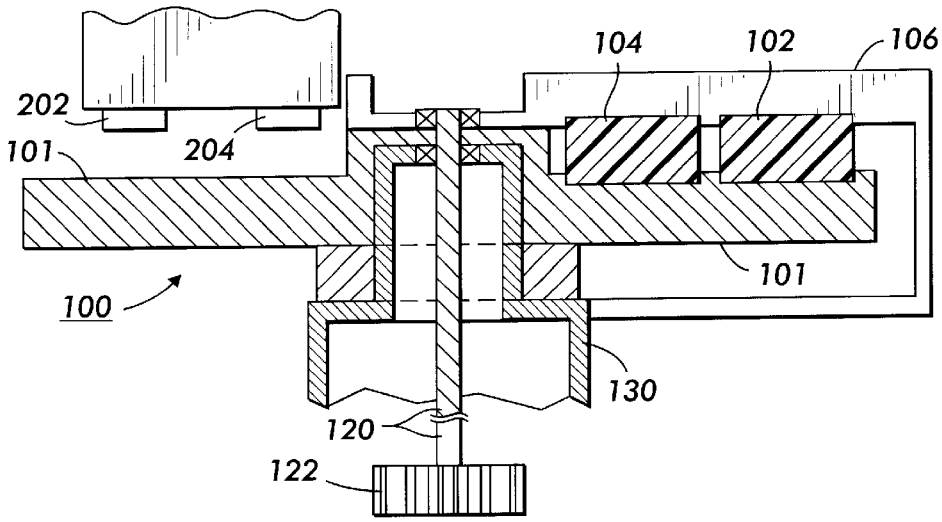
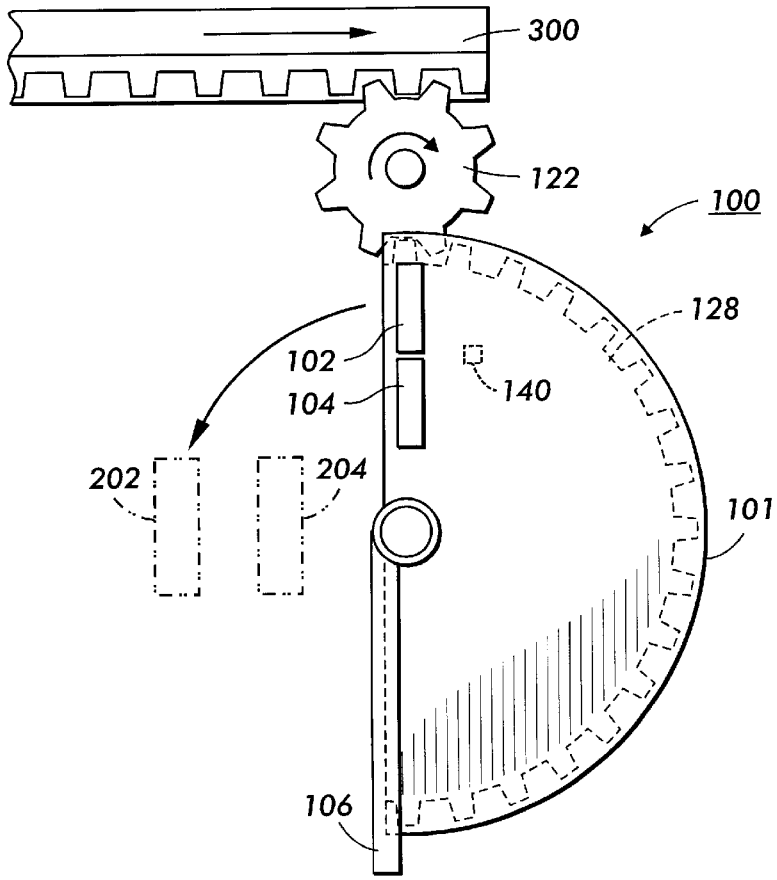
FIG. 5

ROTATING WIPER AND BLOTTER FOR INK JET PRINT HEAD

BACKGROUND OF THE INVENTION

1. Field of Invention

This invention pertains to cleaning devices for print heads in ink jet printers.

2. Description of Related Art

In U.S. patent applications Ser. Nos. 09/594,692 and 09/594,681, each filed on Jun. 16, 2000, each incorporated herein by reference in its entirety, a mechanism is provided for wiping print heads of an ink jet printer and for cleaning the wiping mechanism. The wiping mechanisms disclosed in these applications include a flat plate on which resilient blades are mounted to wipe each print head. The flat plate slides in a straight path between guides, moving the wiping blades past the print heads. The print head wiping blades are cleaned with an absorbent material located at one end of the straight path.

SUMMARY OF THE INVENTION

This invention provides a rotary wiper mechanism for cleaning and/or wiping ink jet print heads.

This invention separately provides a wiping mechanism that moves ink jet print head wiping and/or cleaning structures in a circular path that lies in a plane parallel to the nozzle face of the ink jet print heads.

In various exemplary embodiments of the wiping mechanism according to this invention, the wiping and/or cleaning structures for wiping and/or cleaning the nozzle faces of one or more ink jet print heads are mounted on a rotating rash plate. The rotating rash plate may have different sizes and/or shapes including a half-circle shape or a quarter-circle shape. In various exemplary embodiments, for each of the print heads to be cleaned, at least one wiping and/or cleaning structure is provided on the rash plate spaced from a center of rotation of the rash plate at a radius corresponding to the location of the print head nozzle face to be cleaned. In other exemplary embodiments two or more print heads are cleaned using the same wiping and/or cleaning structure. A scraper and/or blotter element is provided to clean and dry the print head wiping and/or cleaning structures. In particular, the scraper and/or blotter element extends radially from the center of rotation of the rash plate. The scraper and/or blotter element is stationary. Thus, as the wiping and/or cleaning structures mounted on the rash plate move past the print heads to remove ink and/or debris from the nozzle faces of the print heads, the wiping and/or cleaning structures on the rash plate rotate past the scraper and/or blotter element. Thus, the scraper and/or blotter element removes the ink and/or debris from the wiping and/or cleaning elements so that the wiper and/or cleaning elements will remain able to efficiently clean the corresponding print head nozzle face of the ink jet printer in which the rotating cleaning mechanism according to this invention is provided.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein:

FIG. 2 is a top view of a second embodiment of a print head cleaning mechanism of the invention; and FIG. 3 is a side view of a first embodiment of a print head cleaning mechanism drive of the invention.

FIG. 4 is a side view of a second embodiment of a print head cleaning mechanism drive of the invention.

FIG. 5 is a top view of a third embodiment of a print head cleaning mechanism of the invention.

DETAILED DESCRIPTION OF EXEMPLARY EMBODIMENTS

Figure 1:
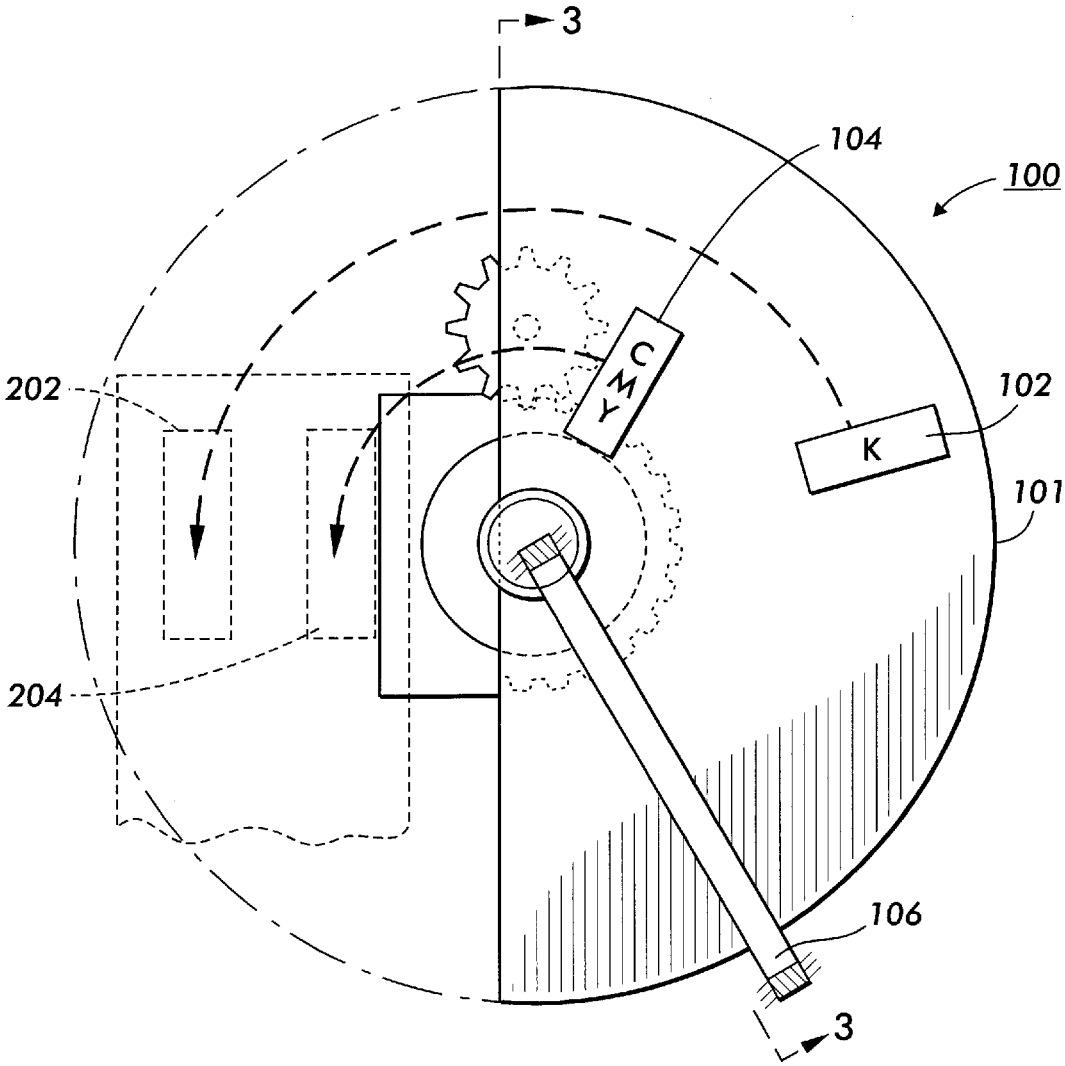
FIG. 1 is a top view of a first embodiment of a print head cleaning mechanism of the invention.

FIG. 1 shows one exemplary embodiment of a wiping mechanism 100 according to this invention. As shown in FIG. 1, the wiping mechanism 100 includes a sector plate/rash plate 101 on which a pair of wiping blades 102 and 104 are located according to this invention. The wiping blades 102 and 104 may be made of a variety of materials, such as, for example, elastomeric resilient material including thermoplastic elastomers such as SARLINK®4165 or 4180, manufactured by DSM Company, thermoplastic polyurethane elastomers, and EPDM, which is a terpolymer elastomer made from ethylene-propylene-diene monomer. The wiping blades 102 and 104 are mounted in or on the sector/rash plate 101 facing out toward a corresponding pair of print heads 202 and 204, which are mounted more or less parallel to the plane of the sector/rash plate 100. The clearance between the sector/rash plate 101 and the print heads 202 and 204 is set such that the wiping blades 102 and 104 will contact and wipe the print heads 202 and 204 when the sector/rash plate moves past the print heads 202 and 204. A first wiping blade 102 is sized and located on or in sector/rash plate 101 so that the first wiping blade 102 will completely wipe the surface of a corresponding first print head 202 when the sector/rash plate 101 rotates past the print heads 202 and 204. Similarly, a second wiping blade 104 is sized and located on or in sector/rash plate 100 so that the second wiping blade 104 will completely wipe the surface of a corresponding second print head 204 when the sector/rash plate 100 rotates past the print heads 202 and 204.

A stationary scraper/blotter element 106 is mounted from the plane of the sector/rash plate 101 at a distance which will bring the wiping blades 102 and 104 in contact with the scraper/blotter element 106 as the sector/rash plate rotates past the stationary scraper/blotter element 106. The contact between the scraper/blotter element 106 and the wiping blades 102 and 104 results in the wiping blades 102 and 104 being cleaned and dried by the scraper/blotter element 106. In this manner, the wiping blades 102 and 104 should be clean and dry when they pass by and wipe the print heads 202 and 204.

While the above-outlined description of FIG. 1 refers to first and second wiping blades 102 and 104 and corresponding first and second print heads 202 and 204, it should be appreciated that the sector plate/rash plate mechanism 100 can be used to clean and/or dry any number of print heads. In particular, depending on the number of distinct print heads provided in the ink jet printer in which the sector plate/rash plate mechanism 100 is used as a nozzle face cleaning mechanism, the sector plate/rash plate mechanism 100 will include sufficient numbers of wiping blades of sufficient radial length such that the nozzle faces of the various ink jet print heads will be sufficiently cleaned and dried that the nozzle orifices of the ink jet print heads are not adversely affected. Thus, while FIG. 1 shows two distinct wiper blades 102 and 104 which are each associated with a corresponding one of the print heads 202 and 204, a single wiper blade having a radial length equivalent to the radial extent between the inner edge of the print head 204 and the outer edge of the print head 202 could be used in place of the two wiper blades 102 and 104. Similarly, a plurality of wiper blades for each of the print heads 202 and 204 could be provided on the sector plate/rash plate 100.

FIG. 2 shows a second embodiment of the sector/rash plate mechanism 100 according to this invention, where the sector plate/rash plate 101 is only a quarter-circle. This embodiment illustrates that the sector/rash plate 101 can be of many different sizes and shapes. Other sizes and shapes would include full circles, three-quarter circles, and plates with cutout portions used to obtain desired weight and/or balance conditions. The sector/rash plate 101 may also be provided in the form of a central disc and a circular annulus with one or more spokes connecting the circular annulus to the central disc. In such an exemplary embodiment of the sector plate/rash plate mechanism 100, the wiping blades 102 and 104 can be mounted on one or more of the spokes. Moreover, as discussed above with respect to FIG. 1, only one wiping blade 102 or 104 needs to be provided to clean more than one print head during one cycle of rotation of the sector/rash plate. FIG. 2 also shows, in dashed line format, the single extended-length wiping blade 110 as discussed above with respect to FIG. 1, could be used instead of or in addition to the wiping blades 102 and 104.

FIG. 3 shows a side view of the first exemplary embodiment of the wiping mechanism 100 drive according to this invention. In the first exemplary embodiment, the sector/rash plate 101 is a semi-circle. The sector/rash plate 101 is mounted on one end of, and supported by, a frame 130. The sector/rash plate 101 has a support 128. In order to rotate the sector/rash plate, a gear face may be provided on the sector/rash plate 101 or on the support 128 or otherwise attached to the sector/rash plate 101. A gear face may be provided on the outer edge of support portion 128, or on the outer perimeter of sector/rash plate 101, or on an upper or lower face of the sector/rash plate 101. A stepper motor (not shown), with or without an intervening gear train of one or more gears, rotates the sector/rash plate 101 by way of a drive shaft 120 and gear 122. The gear 122 can be located in a number of locations as long as it connects to and meshes with the gear on or associated with the sector/rash plate 101. In FIG. 3, the drive shaft 120 and drive gear 122 are shown connected to a gear face provided on the support portion 128 of sector/rash plate 101.

A pulley or other drive mechanisms can be used to drive the sector/rash plate 101.

FIG. 4 shows a second cleaning mechanism 100 drive embodiment according to the invention. In this exemplary embodiment, a drive shaft 120 has a gear 122 at or near one end, passes through the center of support frame 130, and is connected to the rash/sector plate 101 at its other end. The sector/rash plate 101 is driven by the drive shaft 120. The drive shaft 120 may be driven by any suitable driver, such as, for example, a stepper motor (not shown) which has a gear that meshes with drive shaft gear 122.

FIG. 5 shows a third exemplary embodiment of the invention. In the exemplary embodiment shown in FIG. 5, when the rash plate 101 is implemented as a hub, spoke or circular annular or rim structure, the gear 128, shown in hidden view, is provided on the underside of the sector/rash plate 101 adjacent the radially outer surface of the rim. However, the gear 128 may be provided on the outer edge or rim of sector/rash plate 101, or on the top surface of the sector/rash plate 101. In this exemplary embodiment, the drive gear 122 is a pinion 122 which works in conjunction with and moves a carriage rack 300 which may be used to move an ink jet printer ink tank carriage back and forth, for example, in a print engine. A stepper motor (not shown) may be used to drive the carriage or, as indicated above, may be used to directly drive the sector/rash plate 101. The sector/rash plate mechanism 100 can be rotated by the carriage rack to wipe the print heads 202, 204 using gear 122 and can have a return spring (not shown) which may be attached at, for example, post 140 on the underside of the rash/sector plate 101, to return the sector/rash plate mechanism to an original or home position. The return spring (not shown) should slip over the post 140 and as the sector/rash plate 101 rotates, the spring will stretch and rotate as well. The amount of spring rotation can be limited to avoid wrapping the spring around post 140 as the sector/rash plate 101 is rotated. The frame 130 may be constructed to counter-balance any reaction forces of the rotating sector/rash disc 101 during the wiping and scraping of the print heads by the wiper blade(s) 102, 104 or 110, or during the scraping/blotting of the wiper blades by the scraper/blotter element 106. The height of the wiping blades 102 and 104 can be adjusted to improve the cleaning and drying of the print heads 202 and 204.

The wiping blades 102 and 104 can be adjacent to each other, or staggered as shown in FIGS. 1 and 2. As discussed above, a single wiping blade can be used to wipe both of the print heads 202 and 204, provided that a single wiper blade is radially wide enough to extend over the nozzle orifices of both of the print heads 202 and 204. Also, more than two print heads 202 and 204 and wiping blades 102 and 104 may be provided. A retainer screw 124 may be used to secure the scraper/blotter element 106 to the frame 130.

While the invention has been described in conjunction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

What is claimed is:

1. A wiping mechanism usable to wipe ink and/or debris from at least one ink jet print head, comprising:

a plate comprising at least a portion of a circle and mounted substantially parallel to a nozzle face of the at least one ink jet print head;

at least one wiping blade mounted on the plate, each wiping blade located on the plate at a position facing at least one of the at least one ink jet print head;

wherein the plate and the at least one wiping blade are mounted such that the at least one wiping blade is rotatable past the at least one ink jet print head to wipe the at least one ink jet print head.

2. The wiping mechanism of claim 1, wherein the plate is a 180° sector disc.

3. The wiping mechanism of claim 1, wherein the plate is a 90° sector disc.

4. The wiping mechanism of claim 1, wherein at least one separate wiping blade is provided for each of the at least one ink jet print head.

5. The wiping mechanism of claim 1, wherein the at least one ink jet print head comprises a plurality of ink jet print heads; and for at least one of the at least one wiping blade, that wiping blade is provided for at least two of the ink jet print heads.

6. The wiping mechanism of claim 1, wherein the plate is mounted on a rotatable shaft.

7. The wiping mechanism of claim 1, further comprising:

a driver to rotate the plate.

8. The wiping mechanism of claim 7, wherein the driver comprises a carriage to move the print head.

9. The wiping mechanism of claim 8, wherein the driver comprises a stepper motor.

10. The wiping mechanism of claim 9 wherein the stepper motor drives the carriage.

11. The wiping mechanism of claim 7, wherein the driver comprises a stepper motor.

12. The wiping mechanism of claim 11 wherein the stepper motor directly drives the plate.

13. The wiping mechanism of claim 1, wherein the plate is mounted below the at least one print head.

14. The wiping mechanism of claim 1, wherein the plate is rotatable under the at least one print head.

15. The wiping mechanism of claim 1, wherein the plate is rotatable about a single axis substantially perpendicular to the plane of the plate.

16. The wiping mechanism of claim 15, wherein the axis about which the plate is rotatable is located at one edge of the plate.

17. The wiping mechanism of claim 15, wherein the plate has a diameter and the axis about which the plate is rotatable is located in the middle of the plate diameter.

18. A method for wiping at least one ink jet print head, comprising:

rotating at least a plate, which lies substantially within a plane, and at least one wiping blade carried by the plate, about an axis which is substantially perpendicular to the plane, past the one or more print heads to wipe the one or more print heads.

19. The method for wiping according to claim 18, further comprising rotating the wiper blade under the at least one print head.

20. A method for wiping at least one ink jet print head, comprising:

rotating at least a plate and at least one wiping blade past the one or more print heads to wipe the one or more print heads, wherein the plate is in the form of at least a portion of a circular disc.

21. The method of claim 20, wherein the plane of the disc is substantially parallel to the plane of the printhead face.

* * * * *